US008677595B2

(12) United States Patent
Zeng

(10) Patent No.: US 8,677,595 B2
(45) Date of Patent: Mar. 25, 2014

(54) METHOD OF MAKING RETRACTABLE PIPE AND PRODUCT THEREOF

(75) Inventor: Zhengwei Zeng, Guangdong Province (CN)

(73) Assignee: Dongguan Jiede Electronic Technology Co., Ltd., Guangdong Province (CN)

( * ) Notice: Subject to any disclaimer, the term of this patent is extended or adjusted under 35 U.S.C. 154(b) by 0 days.

(21) Appl. No.: 13/568,142

(22) Filed: Aug. 7, 2012

(65) Prior Publication Data

US 2014/0042739 A1 Feb. 13, 2014

(51) Int. Cl.
*B23P 11/00* (2006.01)

(52) U.S. Cl.
USPC ..... 29/434; 15/414; 285/32

(58) Field of Classification Search
CPC ..... C21D 9/08
USPC ..... 29/434; 15/414; 285/32
See application file for complete search history.

(56) References Cited

U.S. PATENT DOCUMENTS

| | | | | |
|---|---|---|---|---|
| 5,692,782 | A * | 12/1997 | Fischer | 285/7 |
| 6,148,474 | A * | 11/2000 | Ohara et al. | 15/377 |
| 6,883,208 | B1 * | 4/2005 | Huang | 16/429 |
| 7,774,901 | B1 * | 8/2010 | Huang | 16/429 |
| 2006/0053585 | A1 * | 3/2006 | Zhang | 15/414 |
| 2011/0018257 | A1 * | 1/2011 | Jeon et al. | 285/303 |

* cited by examiner

*Primary Examiner* — David Bryant
*Assistant Examiner* — Ruth G Hidalgo-Hernandez

(57) ABSTRACT

A method of making retractable pipe, characterized in that it comprises the following steps: (1) preparing a pipe body which comprises an outer pipe and an inner pipe; providing a handle seat and a handle button on the outer pipe; providing a handle actuation means inside the handle seat; providing a push rod assembly, a locking block, a sliding block and a reset spring at the handle actuation means; (2) providing a guiding groove and locking troughs on the inner pipe, and arranging locking troughs on the inner pipe; (3) providing a fixing sleeve inside the handle seat; providing raised guiding rails on the fixing sleeve; the raised guiding rails are slidably inserted in the guiding groove; the sliding block forces a locking tongue to fit into the locking trough to lock the retractable pipe. A retractable pipe made by the above method is also disclosed.

5 Claims, 3 Drawing Sheets

METHOD OF MAKING RETRACTABLE PIPE AND PRODUCT THEREOF

BACKGROUND OF THE INVENTION

The present invention relates to the technique of making retractable pipe, and more specifically relates to a method of making retractable pipe and product thereof.

Currently, retractable pipes available in the market are often applied to vacuum cleaners for convenient cleaning operations. Various kinds of retractable pipes for use with vacuum cleaners are now available, and their suspending, retracting and locking means have different structures. These retractable pipes have a lot of deficiencies, for example, they requires impractical amount of effort to operate and limit the activities of users, and therefore deprived of flexibility and possibilities for selections.

Manufacturers of these retractable pipes have been trying to overcome the present technical deficiencies by solving the impracticability and limitation caused by push button operation so that operation becomes easy and practicable. However, problems such as complicated structure or susceptibility to locking means failure still exist. Besides, these retractable pipes have high production costs and therefore unfavourable for promotion and use in the market.

In order to overcome the above deficiencies, the present invention provides a retractable pipe with reliable locking means and improved structure. It is also easy to operate and low in production costs. The retractable pipe of the present invention has a widened range of applications since it can be applied to a vacuum cleaner as well as other tools which are coupled to the retractable pipe by an external pipe clamp.

BRIEF SUMMARY OF THE INVENTION

In view of the aforesaid disadvantages now present in the prior art, it is an object of the present invention to provide a method of making retractable pipe and product thereof. The retractable pipe of the present invention is disposed with reliable locking means and configured in an improved structure. It is also easy to operate and low in production costs. Accordingly, the dilemma between costs and performance of product now existing in the prior art can be solved.

The above object is attained by the present invention as follows:

A method of making retractable pipe, characterized in that it comprises the following steps:

(1) preparing a pipe body which comprises an outer pipe and an inner pipe; providing a handle seat and a handle button on the outer pipe; providing a handle actuation means inside the handle seat; providing a push rod assembly, a locking block, a sliding block and a reset spring at the handle actuation means; encasing the reset spring on a flange of the sliding block; clutching a front portion of the push rod assembly inside a groove of the sliding block; supporting a rear portion of the push rod assembly at the handle seat; providing a locking tongue on the locking block; and the sliding block and the locking block securely contact and coordinate with each other via two surfaces.

(2) providing a guiding groove and several identical locking troughs on an axial surface of the inner pipe, and arranging in a row the several identical locking troughs on the axial surface of the inner pipe.

(3) providing a fixing sleeve inside the handle seat with the fixing sleeve encasing the inner pipe; providing raised guiding rails on inner sides of the fixing sleeve; the raised guiding rails on the fixing sleeve are slidably inserted in the guiding groove; the sliding block forces the locking tongue on the locking block to fit into the locking trough so that the retractable pipe is in a locked condition.

The method also comprises the following step:

(4) pressing and holding the handle button downward so that the front portion of the push rod assembly acts forward; the sliding block is also moved forward under action force of the push rod assembly; at this moment, the reset spring compresses, the sliding block and the locking block disengages from their contact with each other, thereby releasing the locking tongue on the locking block from the locking trough; as such, the inner pipe could move axially inside the outer pipe under pushing force and extend along a route determined by the raised guiding rails in the fixing sleeve and the guiding groove on the inner pipe, so that the retractable pipe is in an unlocked condition.

Said step (1) also comprises the following step: providing a guiding inner pipe inside the outer pipe.

The method also comprises the following step:

(5) both the guiding inner pipe and the inner pipe are inserted and axially slidable inside the outer pipe, and both could extend axially inside the outer pipe under pushing force; and the inner pipe and the guiding inner pipe have synchronous movements.

The push rod assembly in said step (1) comprises two "U" shaped push rods and a fixing block; two pairs of fixing holes are provided on the fixing block; the two push rods have different lengths; an end of the long end push rod clutches into the groove of the sliding block, and another end of which clutches the fixing holes on the fixing block; an end of the short end push rod is supported at the handle seat, and another end of which clutches the fixing holes on the fixing block; the fixing block is disposed below the handle button.

The fixing sleeve in said step (3) is provided with a slot on its surface wherein the sliding block, the locking block and the reset spring are disposed inside the slot.

A retractable pipe made by the above method includes a pipe body wherein the pipe body comprises the outer pipe and the inner pipe; and characterized in that the handle seat and the handle button are provided on the outer pipe; the handle actuation means is provided inside the handle seat; the push rod assembly, the locking block, the sliding block and the reset spring are provided at the handle actuation means; the reset spring encases the flange of the sliding block; the front portion of the push rod assembly is clutched inside the groove of the sliding block; the rear portion of the push rod assembly is supported at the handle seat; the locking tongue is provided on the locking block; and the sliding block and the locking block securely contact and coordinate with each other via two surfaces; the guiding groove and several identical locking troughs are provided on the axial surface of the inner pipe; the fixing sleeve is provided inside the handle seat with the fixing sleeve encasing the inner pipe; raised guiding rails are provided on the inner sides of the fixing sleeve.

The guiding inner pipe is provided inside the outer pipe, wherein both the guiding inner pipe and the inner pipe are inserted and axially slidable inside the outer pipe, and both could extend axially inside the outer pipe under pushing force; and the inner pipe and the guiding inner pipe have synchronous movements.

The push rod assembly comprises the two "U" shaped push rods and the fixing block; the two pairs of fixing holes are provided on the fixing block; the two push rods have different lengths; the end of the long end push rod clutches into the groove of the sliding block, and the other end of which clutches the fixing holes on the fixing block; the end of the short end push rod is supported at the handle seat, and the other end of which clutches the fixing holes on the fixing block; the fixing block is disposed below the handle button.

The fixing sleeve is provided with the slot on its surface wherein the sliding block, the locking block and the reset spring are disposed inside the slot.

A front end and a rear end of the retractable pipe are provided with an inner pipe seat and an outer pipe seat respectively; the inner pipe seat comprises an inner pipe seat cover, a fixing button and a fixing cover; the inner pipe seat is connected with the guiding inner pipe and the inner pipe; the outer pipe seat comprises an outer pipe seat cover; the outer pipe seat is connected with the outer pipe. The retractable pipe is made by stainless steel or aluminum alloy.

The present invention has the following advantages: by using press button to suspend and retract a pipe body, the retractable pipe of the present invention has the advantages of easy operation, improved structure and low production costs. By changing conventional structure of a retractable pipe, the present invention solves the dilemma between costs and performance of product and provides a retractable pipe with a widened range of applications.

The present invention will be further described below with reference to accompanying drawings and a detailed description of the present invention.

DETAILED DESCRIPTION OF THE INVENTION

Figure 1:
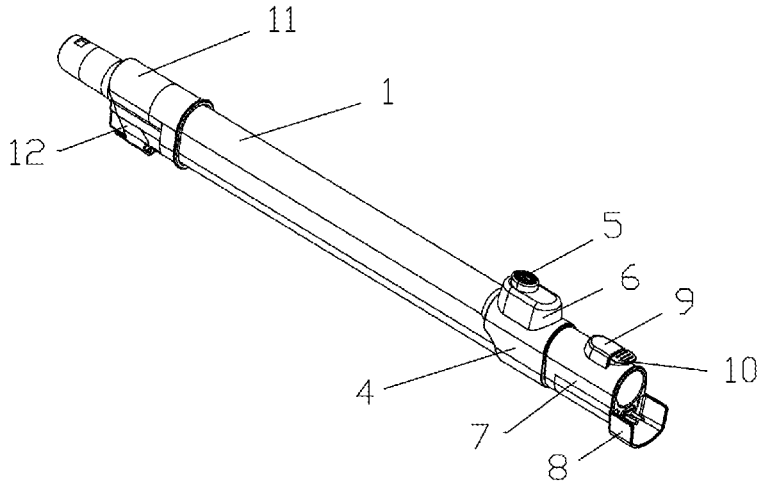
FIG. 1 illustrates a perspective structural view of the retractable pipe of the present invention.
Figure 2:
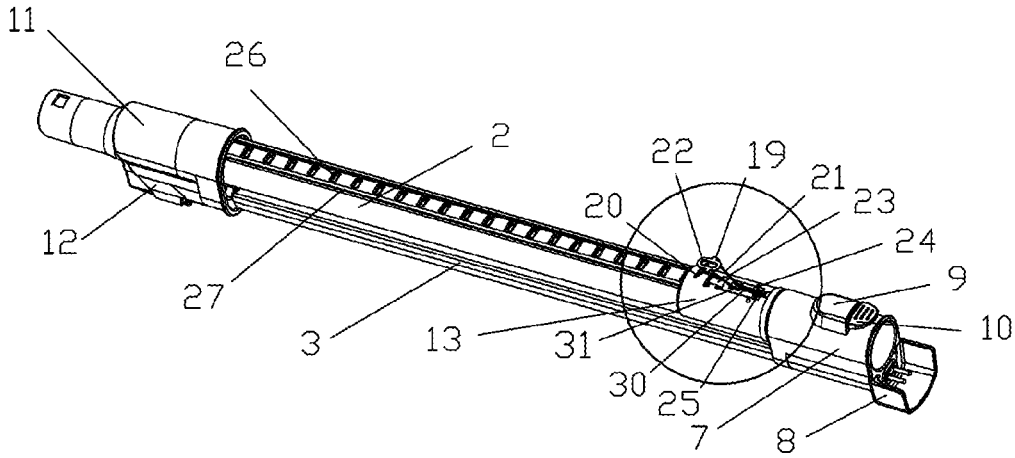
FIG. 2 illustrates an internal structural view of the retractable pipe of the present invention.
Figure 3:
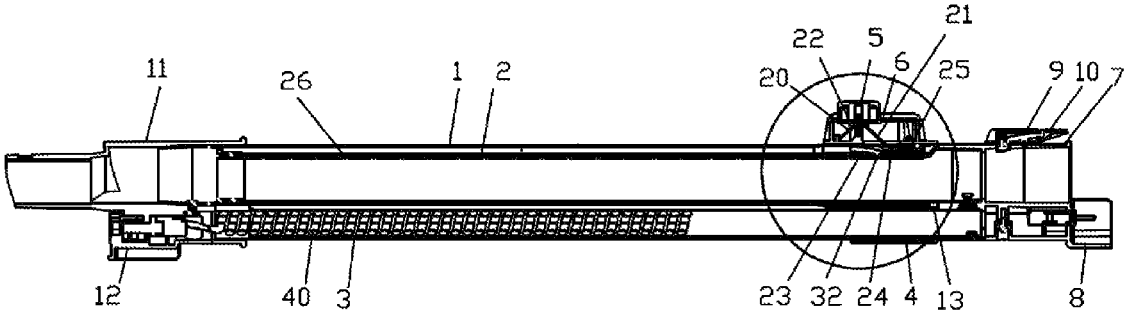
FIG. 3 illustrates a sectional structural view of the retractable pipe of the present invention.
Figure 4:
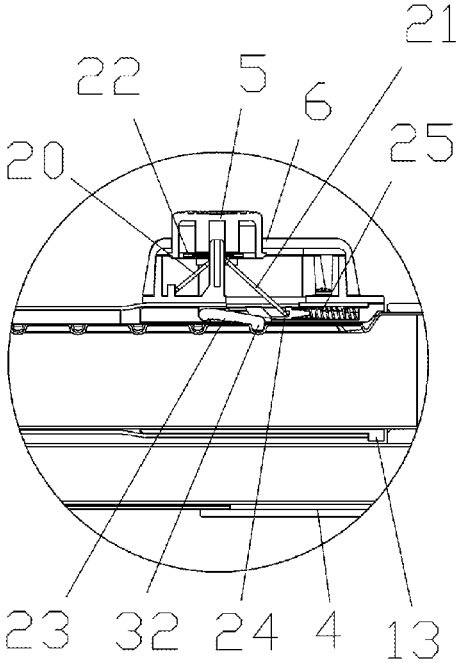
FIG. 4 is an enlarged view of the circled part in FIG. 3.
Figure 5:
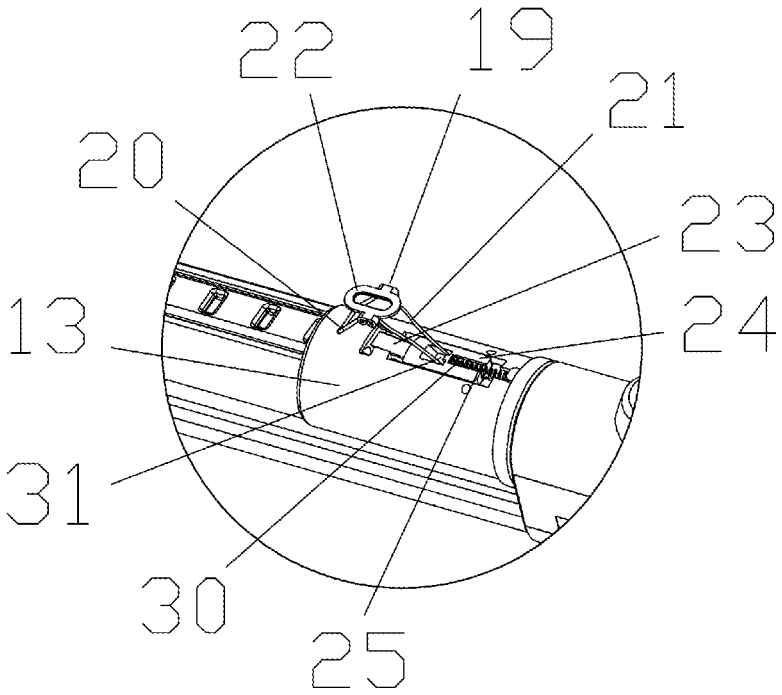
FIG. 5 is an enlarged view of the circled part in FIG. 2.

An embodiment of the present invention as shown in FIG. 1 to FIG. 5 discloses a method of making retractable pipe. The method comprises the following steps:

(1) preparing a pipe body which comprises an outer pipe 1 and an inner pipe 2; providing a handle seat 4 and a handle button 5 on the outer pipe; providing a handle actuation means inside the handle seat 4; providing a push rod assembly 19, a locking block 23, a sliding block 24 and a reset spring 25 at the handle actuation means; encasing a flange 30 of the sliding block 24 by the reset spring 25; clutching a front portion 21 (i.e. a long end push rod) of the push rod assembly 19 inside a groove 31 of the sliding block 24; supporting a rear portion 20 (i.e. a short end push rod) of the push rod assembly 19 at the handle seat 4; providing a locking tongue 32 on the locking block 23; and the sliding block 24 and the locking block 23 securely contact and coordinate with each other via two surfaces.

(2) providing a guiding groove 27 and several identical locking troughs 26 on an axial surface of the inner pipe 2, and arranging in a row the several identical locking troughs 26 on the axial surface of the inner pipe 2.

(3) providing a fixing sleeve 13 inside the handle seat 4 with the fixing sleeve 13 encasing the inner pipe 2; providing raised guiding rails (not shown in the figures) on inner sides of the fixing sleeve 13; the raised guiding rails on the fixing sleeve 13 are slidably inserted in the guiding groove 27; the sliding block 24 forces the locking tongue 32 on the locking block 23 to fit into the locking trough 26 so that the retractable pipe is in a locked condition.

The method also comprises the following step:

(4) pressing and holding the handle button 5 downward so that the front portion of the push rod assembly acts forward; the sliding block 24 is then moved forward under action force of the push rod assembly; at this moment, the reset spring 25 compresses and the sliding block 24 and the locking block 23 disengages from their contact with each other, thereby releasing the locking tongue 32 on the locking block 23 from the locking trough 26; as such, the inner pipe 2 could move axially inside the outer pipe 1 under pushing force and extend along a route determined by the raised guiding rails in the fixing sleeve 13 and the guiding groove 27 on the inner pipe 2, so that the retractable pipe is in an unlocked condition.

Said step (1) also comprises the following step: providing a guiding inner pipe 3 inside the outer pipe 1.

The method also comprises the following step:

(5) both the guiding inner pipe 3 and the inner pipe 2 are inserted and axially slidable inside the outer pipe 1, and both could extend axially inside the outer pipe 1 under pushing force; and the inner pipe 2 and the guiding inner pipe 3 have synchronous movements.

The push rod assembly 19 in said step (1) comprises two "U" shaped push rods (20, 21) and a fixing block 22; two pairs of fixing holes are provided on the fixing block 22; the two push rods (20, 21) have different lengths; an end of the long end push rod 21 clutches into the groove 31 of the sliding block 24, and another end of which clutches the fixing holes on the fixing block 22; an end of the short end push rod 20 is supported at the handle seat 4, and another end of which clutches the fixing holes on the fixing block 22; the fixing block 22 is disposed below the handle button 5.

The fixing sleeve 13 in said step (3) is provided with a slot on its surface wherein the sliding block 24, the locking block 23 and the reset spring 25 are disposed inside the slot.

A retractable pipe made by the above method includes a pipe body; the pipe body comprises the outer pipe 1 and the inner pipe 2; the handle seat 4 and the handle button 5 are provided on the outer pipe 1; a button cover 6 is provided at an outer rim of the handle button 5; the handle actuation means is provided inside the handle seat 4; the push rod assembly 19, the locking block 23, the sliding block 24 and the reset spring 25 are provided at the handle actuation means; the reset spring 25 encases the flange 30 of the sliding block 24; the front portion 21 (i.e. the long end push rod) of the push rod assembly 19 is clutched inside the groove 31 of the sliding block 24; the rear portion 20 (i.e. the short end push rod) of the push rod assembly 19 is supported at the handle seat 4; the locking tongue 32 is provided on the locking block 23; and the sliding block 24 and the locking block 23 securely contact and coordinate with each other via two surfaces; the guiding groove 27 and several identical locking troughs 26 are provided on the axial surface of the inner pipe 2; the fixing sleeve 13 is provided inside the handle seat with the fixing sleeve 13 encasing the inner pipe 2; raised guiding rails (not shown in the figures) are provided on the inner sides of the fixing sleeve 13.

The guiding inner pipe 3 is provided inside the outer pipe 1, wherein both the guiding inner pipe 3 and the inner pipe 2 are inserted and axially slidable inside the outer pipe 1, and both could extend axially inside the outer pipe 1 under pushing force; the inner pipe 2 and the guiding inner pipe 3 have synchronous movements; a spiral type electrically conductive wire 40 is provided inside the guiding inner pipe 3; the guiding inner pipe 3 could protect the electrically conductive wire 40 effectively.

The push rod assembly 19 comprises the two "U" shaped push rods (20, 21) and the fixing block 22; the two pairs of fixing holes are provided on the fixing block 22; the two push rods (20, 21) have different lengths; the end of the long end push rod 21 clutches into the groove 31 of the sliding block 24, and the other end of which clutches the fixing holes on the fixing block 22; the end of the short end push rod 20 is supported at the handle seat 4, and the other end of which clutches the fixing holes on the fixing block 22; the fixing block 22 is disposed below the handle button 5.

The fixing sleeve 13 is provided with the slot on its surface wherein the sliding block 24, the locking block 23 and the reset spring 25 are disposed inside the slot.

A front end and a rear end of the retractable pipe are provided with an inner pipe seat 7 and an outer pipe seat 11 respectively; the inner pipe seat 7 comprises an inner pipe seat cover 8, a fixing button 10 and a fixing cover 9; the inner pipe seat 7 is connected with the guiding inner pipe 3 and the inner pipe 2; the outer pipe seat 11 comprises an outer pipe seat cover 12; the outer pipe seat 11 is connected with the outer pipe 1.

The retractable pipe is made by stainless steel which could effectively prevent rusting of the retractable pipe.

Operation procedures of the above embodiment of the present invention is described in detail below with reference to FIG. 1 to FIG. 5:

FIG. 1 shows an initial condition of the retractable pipe. In other words, the entire retractable pipe is in a locked condition, the locking block 23 clutches in the locking trough 26, a bottom surface of the sliding block 24 is pressed against an upper surface of the locking block 23, and the locking tongue 32 on the locking block 23 is forced to fit into the locking trough 26 by the locking block 24. At this moment, the inner pipe 2 and the guiding inner pipe 3 inside the outer pipe 1 are not movable and the retractable pipe has a fixed length.

To adjust the length of the retractable pipe, press and hold the handle button 5 so that the push rod assembly 19 is under pressure; given that an end of the short end push 20 of the push rod assembly is supported at the handle seat 4 and an end of the long end push rod 21 clutches at the groove 31 on the sliding block 24, the short end push rod 20 will not act rearward due to supporting force at the handle seat 4 while the long end push rod will move forward under action force and thereby driving the sliding block 24 to move forward and compressing the reset spring 25; at this moment, the sliding block 24 and the locking block 23 disengages from their contact with each other, thereby releasing the locking tongue 32 on the locking block 23 from the locking trough 26; since the outer pipe is fixedly mounted on the pipe body, the inner pipe 2 and the guiding inner pipe 3 could move axially inside the outer pipe 1 under pushing force and extend along a route determined by the raised guiding rails in the fixing sleeve 13 and the guiding groove 27 on the inner pipe 2 so as to effectively prevent deviation of the inner pipe 2 when it extends. When the retractable pipe is extended to a certain length, release the handle button 5 so that the push rods are no longer under pressure and the reset spring 25 is decompressed to its original position; at this moment, the bottom surface of the sliding block 24 is pressed against the upper surface of the locking block 23 once again, and the locking tongue 32 is once again forced to fit into the locking trough 26. The operation procedures are now completed and the retractable pipe is then in a fixed condition after extension (the fixed condition after extension is not shown in the figures).

To adjust the retractable pipe back to its initial condition, follow the above operation procedures to retract the inner pipe 2 and the guiding inner pipe 3 into the outer pipe 1.

The embodiment disclosed herein is not only applicable to a vacuum cleaner, but also applicable to other tools coupled to the retractable pipe by an external pipe clamp.

Compared with the existing prior arts, by using press button to suspend and retract a pipe body, the retractable pipe of the present invention has the advantages of easy operation, improved structure and low production costs. By changing conventional structure of a retractable pipe, the present invention solves the dilemma between costs and performance of product and provides a retractable pipe with a widened range of applications and a maximized practical value.

The present invention is not limited to the embodiment described herein. Any method, system or structure similar to the present invention for the purpose of attaining the object of the present invention should also fall within the scope of protection of the present invention.

What is claimed is:

1. A method of making retractable pipe, characterized in that it comprises the following steps:

(1) preparing a pipe body which comprises an outer pipe and an inner pipe; providing a handle seat and a handle button on the outer pipe; providing a handle actuation means inside the handle seat; providing a push rod assembly, a locking block, a sliding block and a reset spring at the handle actuation means; encasing a flange of the sliding block by the reset spring; clutching a front portion of the push rod assembly inside a groove of the sliding block; supporting a rear portion of the push rod assembly at the handle seat; providing a locking tongue on the locking block; and the sliding block and the locking block securely contact and coordinate with each other via two surfaces;

(2) providing a guiding groove and several identical locking troughs on an axial surface of the inner pipe, and arranging in a row the several identical locking troughs on the axial surface of the inner pipe;

(3) providing a fixing sleeve inside the handle seat with the fixing sleeve encasing the inner pipe; providing raised guiding rails on inner sides of the fixing sleeve; the raised guiding rails on the fixing sleeve are slidably inserted in the guiding groove; the sliding block forces the locking tongue on the locking block to fit into the locking trough so that the retractable pipe is in a locked condition.

2. The method of making retractable pipe as in claim 1, characterized in that it also comprises the following step:

(4) pressing and holding the handle button downward so that the front portion of the push rod assembly acts forward; the sliding block is also moved forward under action force of the push rod assembly; at this moment, the reset spring compresses, the sliding block and the locking block disengages from their contact with each other, thereby releasing the locking tongue on the locking block from the locking trough; as such, the inner pipe moves axially inside the outer pipe under pushing force and extends along a route determined by the raised guiding rails in the fixing sleeve and the guiding groove on the inner pipe, so that the retractable pipe is in an unlocked condition.

3. The method of making retractable pipe as in claim 2, characterized in that said step (1) also comprises the following step: providing a guiding inner pipe inside the outer pipe; and the method also comprises the following steps; (5) both the guiding inner pipe and the inner pipe are inserted and axially slidable inside the outer pipe, and both of them extend axially inside the outer pipe under pushing force; and the inner pipe and the guiding inner pipe have synchronous movements.

4. The method of making retractable pipe as in claim 1, characterized in that the push rod assembly in said step (1) comprises two "U" shaped push rods and a fixing block; two pairs of fixing holes are provided on the fixing block; the two push rods have different lengths; an end of a long end push rod clutches into the groove of the sliding block, and another end of which clutches the fixing holes on the fixing block; an end of a short end push rod is supported at the handle seat, and another end of which clutches the fixing holes on the fixing block; the fixing block is disposed below the handle button.

5. The method of making retractable pipe as in claim 1, characterized in that the fixing sleeve in said step (3) is provided with a slot on its surface wherein the sliding block, the locking block and the reset spring are disposed inside the slot.

* * * * *